US011638493B2

(12) United States Patent
Haruna

(10) Patent No.: US 11,638,493 B2
(45) Date of Patent: May 2, 2023

(54) VASE APPARATUS

(71) Applicant: Samantha Haruna, London (GB)

(72) Inventor: Samantha Haruna, London (GB)

( * ) Notice: Subject to any disclaimer, the term of this patent is extended or adjusted under 35 U.S.C. 154(b) by 191 days.

(21) Appl. No.: 16/652,254

(22) PCT Filed: Sep. 27, 2018

(86) PCT No.: PCT/IB2018/057508
§ 371 (c)(1),
(2) Date: Jun. 8, 2020

(87) PCT Pub. No.: WO2019/064227
PCT Pub. Date: Apr. 4, 2019

(65) Prior Publication Data

US 2021/0321798 A1 Oct. 21, 2021

(30) Foreign Application Priority Data

Sep. 28, 2017 (GB) ..... 1715677

(51) Int. Cl.
*A47G 7/06* (2006.01)
*A47G 7/02* (2006.01)

(52) U.S. Cl.
CPC ..... *A47G 7/06* (2013.01); *A47G 7/025* (2013.01)

(58) Field of Classification Search
CPC ..... A47G 7/06; A47G 7/025
See application file for complete search history.

(56) References Cited

U.S. PATENT DOCUMENTS 998,322 A 7/1911 Bone
1,423,906 A 7/1922 Brettschneider
1,765,140 A * 6/1930 Fitl ..... A47G 7/06 47/41.01
2,070,940 A * 2/1937 Duchan ..... A01G 5/04 428/10
2,095,290 A * 10/1937 Roy ..... E04H 13/003 52/302.1

(Continued)

FOREIGN PATENT DOCUMENTS

FR 1011962 7/1952
FR 1089765 3/1955

(Continued)

OTHER PUBLICATIONS

Combined Search and Examination Report, GB1715677.9 (dated Mar. 28, 2018).

(Continued)

*Primary Examiner* — Monica L Perry
*Assistant Examiner* — Brittany A Lowery
(74) *Attorney, Agent, or Firm* — William H. Bollman

(57) ABSTRACT

A vase apparatus includes a vase supported by a ground engagement mechanism such that the vase can be displaced from the ground engagement mechanism. The ground engagement mechanism is arranged to enable the vase to be presented substantially vertically. At least one displaceable portion extends from the ground engagement mechanism or the vase. Each displaceable portion includes a plurality of apertures for receiving bunches of flowers or stems of individual flowers or plants.

8 Claims, 9 Drawing Sheets

(56) References Cited

U.S. PATENT DOCUMENTS

| | | | | | |
|---|---|---|---|---|---|
| 2,733,549 | A * | 2/1956 | Moore | A47G 7/06 | 47/41.01 |
| 3,065,947 | A * | 11/1962 | Thompson | A47G 7/025 | 47/41.01 |
| 4,306,376 | A * | 12/1981 | Strassacker | A47G 7/06 | 248/346.04 |
| 2005/0102898 | A1 | 5/2005 | Powless | | |
| 2015/0315806 | A1* | 11/2015 | Heard | F21V 21/0832 | 248/27.8 |
| 2016/0047138 | A1* | 2/2016 | McCaslin | E04H 13/001 | 52/103 |

FOREIGN PATENT DOCUMENTS

| | | | | |
|---|---|---|---|---|
| FR | 2736551 | A1 * | 1/1997 | B43M 99/00 |
| GB | 650018 | A | 2/1951 | |
| JP | 2011231510 | | 11/2011 | |
| JP | 201236677 | | 2/2012 | |
| JP | 2012036677 | A * | 2/2012 | |
| JP | 5 474702 | | 4/2014 | |
| JP | 5474702 | B2 * | 4/2014 | A47G 7/06 |

OTHER PUBLICATIONS

Notification of Transmittal of the International Search Report and the Written Opinion of the International Searching Authority, or the Declaration, PCT/IB2018/057508.

* cited by examiner

VASE APPARATUS

FIELD OF THE INVENTION

The present invention relates to a vase apparatus, in particular a vase apparatus for inserting into the ground; for example a vase apparatus for funerary flowers and plants.

BACKGROUND

Increasingly care and attention is paid to graves in many societies.

Many graves are situated in outdoor graveyards or similar particularly in the United Kingdom.

Due to resultant climatic conditions maintenance of flowers and plants and wreaths at these graves can be problematic, as vases can topple over in the wind, and wreaths and flowers can be blown away.

PRIOR ART

US 2015 0 315 806 (HEARD) discloses a resting place vase hook including an attachment means and at least one arm, which attachment means is attachable to a vase, and which arms extend from the attachment means and each have a hook. The hooks are operable to hang an adornment in an elevated position.

DE 202 005 012 226 (MUELLER) discloses a topple-proof arrangement for enclosing a plant pot, which has a rigid framework and at least three contact points to the floor surface and fixing means for a plant pot.

U.S. Pat. No. 6,128,855 (SALAMH et al) discloses apparatus comprising a cemetery vase constructed as a container with a spike protruding from a hole in the bottom to permit the spike to be forced into the ground for support. The container is plastic, the spike has circumferential serrations to mechanically lock it in place, and no adhesive is required for assembly. The container is formed with surface ribs adjacent to the hole to strengthen the structure to prevent damage by insertion of the spike, and the container also has internal fins to grip a foam plug which can hold the flowers.

JP2011231510 (KONDO) discloses a device for holding flowers with a volume and ground engagement portion.

US 20160047138 (McCASLIN et al) discloses a holder and ground engaging part with a holding securement in between.

GB650018 (HALL) discloses a flower holder in the form of a vase with volume, ground engagement portion and securement.

The present invention arose in order to overcome problems suffered by existing devices.

SUMMARY OF THE INVENTION

According to the present invention there is provided a vase apparatus comprising: a vase supported by a ground engagement mechanism which enables the vase to be displaced from the ground engagement mechanism, the ground engagement mechanism is arranged to enable the vase to be presented substantially vertically; the ground engagement mechanism has at least one displaceable portion which extends therefrom, each displaceable portion has a plurality of apertures for receiving a bunch of flowers/plants or individual stems of flowers/plants.

According to a second aspect of the present invention there is provided a vase apparatus comprising: a vase supported by a ground engagement mechanism which enables the vase to be displaced from the ground engagement mechanism, the ground engagement mechanism is arranged to enable the vase to be presented substantially vertically; the vase has at least one displaceable portion which extends therefrom; each displaceable portion has a plurality of apertures for receiving a bunch of flowers/plants or individual stems of flowers/plants.

In this way multiple bunches of flowers/plants, posies or individual stems of flowers or plants can be displayed on the vase apparatus that may be arranged on a single grave. The apertures in the displaceable portions are adapted to receive stems of the flowers or plants. Advantageously this can enable more than one individual to display their flowers on one grave, without encroaching on an adjacent grave or graves.

The vase or housing which receives plant stems may be formed in various shapes. In a preferred embodiment the vase is of a tapering form, tapering towards the ground and/or ground engagement mechanism to define a narrowing end to which the stems are directed. For example the vase may be frusto-conical shaped.

In this way the volume of the vase, being defined by the shape, is arranged to accept stems of flowers or plants. The apparatus is consequently enabled to function as a flower vase that is mounted on or to a ground engagement mechanism so as to secure the vase in position where it may accept plants and flowers. The apparatus is suitable for outdoor locations and is typically for use at a funeral, burial setting or memorial location. It is appreciated that the vase apparatus is suitable for any location.

In some embodiments the ground engagement mechanism is arranged in use to extend or depend from the housing, so as to engage the housing into the ground in a temporary or semi-permanent manner. In this way at least part of the apparatus may be displaced from the ground, for example wherein the housing may be separated from the ground engagement mechanism and ground.

The ground engagement portion may be in the form of a ground spike or coil that is inserted into the ground. In another embodiment the ground engagement means may be a stand that supports the apparatus.

Preferably the volume defined by the vase (housing) is watertight, so as to allow for fluid to be used and held within the volume, to better maintain any plants.

In other embodiments the volume may be perforated or provided with drainage.

In some embodiments the housing may be displaceable from the ground engagement mechanism, so as to allow for easy refilling of fluid in the volume or addition or removal of a plant growth medium or plant support medium such as a floral foam block.

For example the housing and ground engagement mechanism may engage by means of a securement mechanism, wherein the housing and ground engagement mechanism have corresponding parts or means to permit connection and disconnection. Such securement mechanism may comprise a screw thread or bayonet mechanism, so as to limit dislodgement of the vase from the ground engagement mechanism whilst the flowers and or plants are displayed.

The securement mechanism is typically formed as part of the corresponding faces of the vase and ground engagement mechanism that engage to form the connection. In this way separate parts are not required, although it is appreciated that in some embodiments the vase and ground engagement mechanism may accept separate parts to enable securement together.

In some embodiments the vase and ground engagement mechanism may be formed as a single piece for ease of assembly.

In some embodiments the securement mechanism between the vase and ground engagement mechanism may be achieved through gravity, such that the vase sits within or upon the ground engagement mechanism.

In some embodiments the ground engagement mechanism may further comprise a cradle for receiving the vase/housing. The cradle is typically arranged to surround the housing at least in part, or provide a hook, base or platform upon which the vase can securely rest. This permits the vase to be displaced substantially vertically from the cradle and the accompanying parts of the ground engagement mechanism. In such an embodiment the displaceable portions may extend from the cradle part of the ground engagement means.

In some embodiments the apparatus may further comprise a wreath holding means, which wreath holding means may comprise a means to maintain an annular wreath in a relatively stable position. The wreath holding means may also be arranged to enable a wreath to be displayed in relation to the vase.

For example in some embodiments the wreath holding means may comprise a distance providing means, spacing the wreath away from the vase so as to maintain the wreath at a substantially fixed distance. In this way the wreath can be tastefully displayed in addition to flowers, plants and posies.

In some embodiments the wreath holding means may comprise at least one elongate member. The elongate member is adapted to receive the wreath.

In some embodiments the apparatus may comprise a handle or handles, being handle(s) for carrying or displacing the apparatus or part of the apparatus, for example the vase/housing.

A handle may be used to displace the vase from the ground engagement mechanism so that it can be easily lifted out. Such handle or handles may be partly or wholly displaceable so as to minimise their size when not in use.

In some embodiments the wreath holding means may also serve as a handle.

Such handle or handles may be partly or wholly displaceable so as to minimise their size when not in use.

The apparatus has at least one displaceable portion. Each displaceable portion has a plurality of apertures for receiving stems or posies of flowers or plants so as to enable multiple items to be displayed on the apparatus.

The displaceable portion may be displaceably connected to the ground engagement mechanism or the vase.

Typically the apparatus can accommodate several displaceable portions. The portions can be added to and removed from the apparatus so as to alter the number of items that can be displayed or to exchange the type of portion which is attached. For example displaceable portions may have different number and size of apertures to accommodate different plants, flowers or posies. A user may select the portion depending upon the item that they wish to display.

The portion is typically connected by a connection mechanism such as interlocking portions, mating parts, a hinge, hole and pin configuration or other connection mechanism that enables two parts to be connected.

In some embodiments the displaceable portion remains connected to the apparatus and can be displaced into different orientations. For example the displaceable portion may be arranged in a stowed position and a display configuration.

In some embodiments each portion can be arranged at two or more display configurations, for example the portion may be adjusted incrementally to different positions.

The portions may consequently comprise arms and/or perforations/apertures, wherein the objects and items may be placed in the perforations or aperture, and/or held in or suspended from the arms. In this way objects and items may be added to the apparatus for display purposes.

Displaceable portions may comprise leaf-like portions extending outwards from the ground engagement mechanism or vase, wherein the displaceable portions may be arranged to receive flowers.

In some embodiments an enclosure may extend from the displaceable portions, and in particular from an aperture or about a plurality of apertures, so as to capture and enclose the stem ends. The enclosure typically defines a capture region for the stems.

The enclosure may be formed by a net or fabric material, or the enclosure may be substantially rigid such as defining tubes or containers into which the stem ends extend once they have passed through an aperture. In some embodiments the enclosure may be formed from flexible and rigid regions. In this way the stem ends are contained which will help ensure each flower or plant is displayed in a substantially upright orientation and may hide the stem ends to enhance appearance.

The enclosure may have a decorated external surface or be shaped to provide an ornamental design.

The enclosure may also permit the holding of water or growth medium for the plants or flowers. For example, at least part of the enclosure may be waterproof.

The enclosure may be removeable from the displaceable portion. For example the enclosure may be a net that is fitted to an outer edge of the displaceable portion so as to extend downwards from a lower face of the displaceable portion.

The enclosure may be connected to the displaceable portion in various ways. For example a flexible enclosure may have an elasticated edge to stretch over the displaceable portion. In some embodiments the displaceable portion and enclosure may have a connection means such as a channel for receiving a corresponding notch or edge.

In this way the enclosure may be changed or replaced as desired. It is appreciated that different enclosures may be provided to accommodate different arrangements of stems or to alter the appearance of the apparatus.

In some embodiments the enclosure may be an integrated part of the displaceable portion, for example being moulded as a single part.

In some embodiments the apparatus may comprise further object holding or maintenance portions. Such portions may be partly or wholly displaceable so as to minimise their size when not in use. Such objects may comprise further stems, plants, trinkets or mementos which may be envisaged to be artificial and not requiring water or fluid.

Preferred embodiments of the invention will now be described by way of example only and with reference to the Figures in which:

DETAILED DESCRIPTION OF FIGURES

Figure 1:
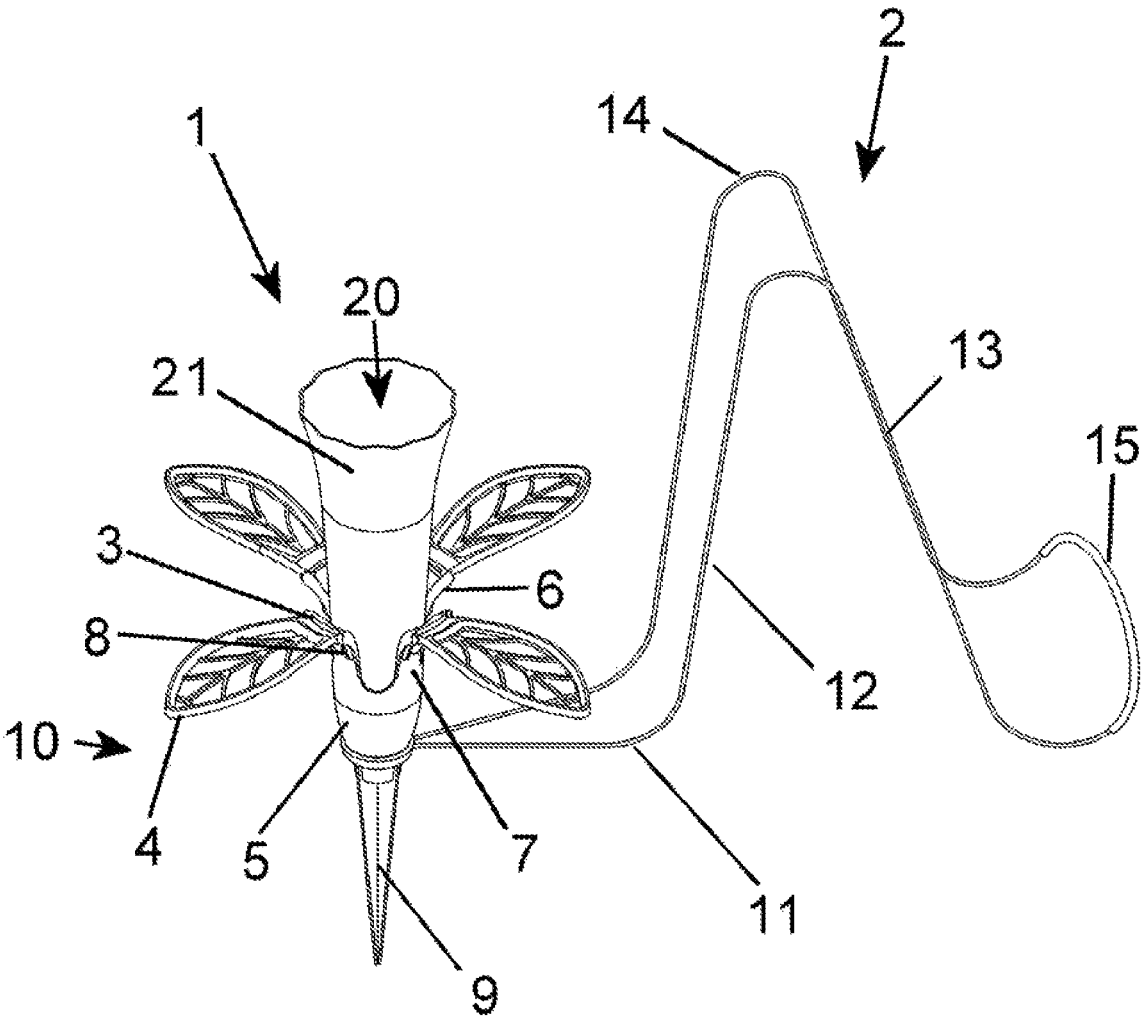
FIG. 1 shows an isometric view of a first embodiment of the apparatus according to the present invention.
Figure 2:
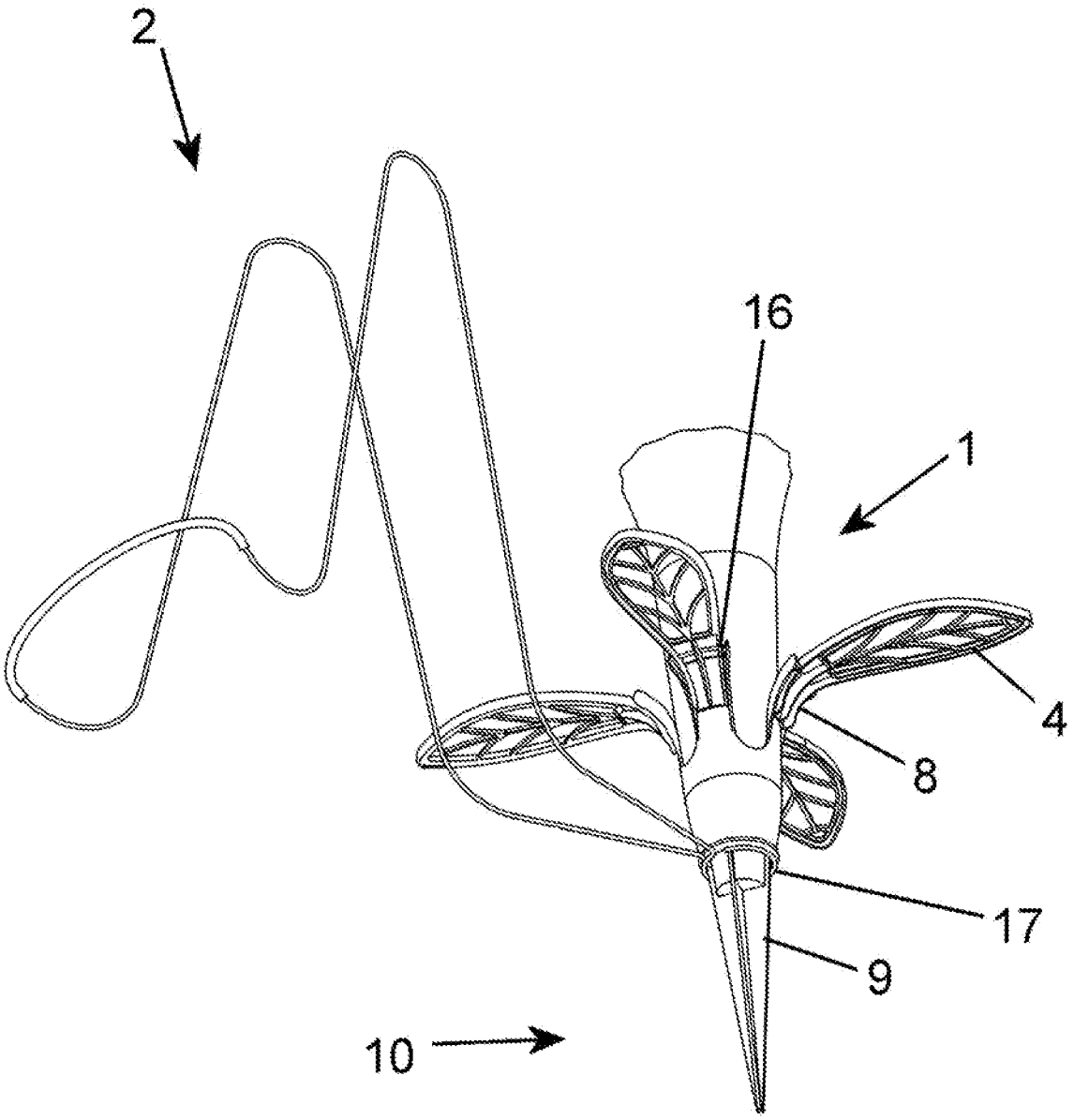
FIG. 2 shows a reverse isometric view of the embodiment shown in FIG. 1.
Figure 3:
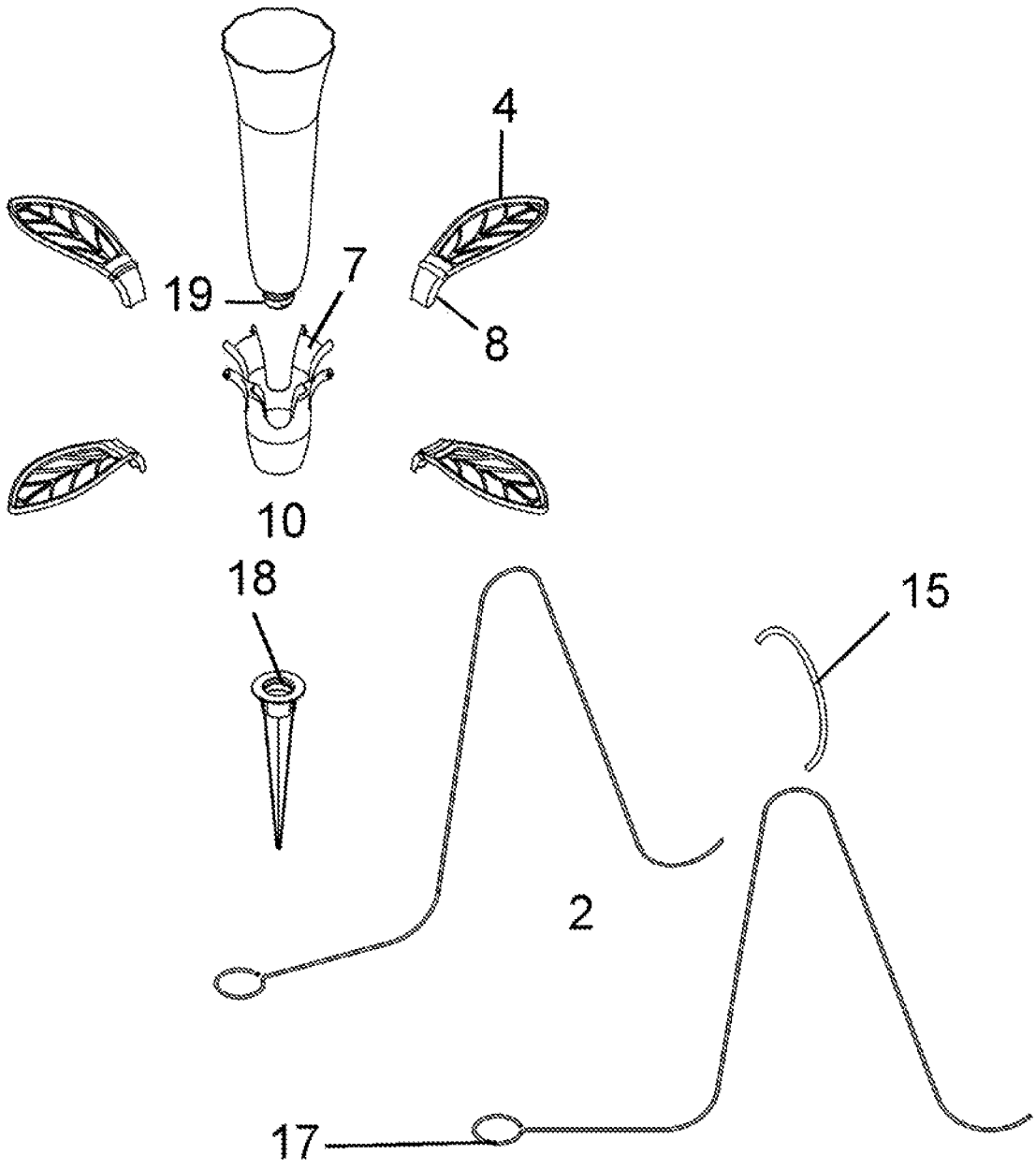
FIG. 3 shows an exploded isometric view of the embodiment shown in FIG. 1.

With reference to the embodiment shown in FIGS. 1 to 3 there is shown an embodiment of the apparatus comprising an inverted frusto-conical vase 1 defining an internal volume 20 for receipt of stems of flowers and plants. The vase 1 is arranged to locate into a ground engagement mechanism 10 comprising a spike 9.

The vase or housing 1 comprises an outer 21 forming an open top face leading to the volume 20. The internal volume 20 has a tapering form, and is watertight.

The ground engagement mechanism 10 is contiguous with a securement mechanism comprising a cradle 5 as shown in FIG. 1, which cradle 5 is arranged to accept the vase's bottom end and maintain it secured horizontally and vertically under gravity. The cradle 5 and ground engagement mechanism 10 are a single part, wherein the cradle 5 provides a concave interior for receipt of the vase and the vase has a male screwthread lowermost to engage a female screwthread of the ground engagement mechanism and trap the cradle 5 between the ground spike and the vase.

The apparatus further includes extending wreath holding means 2, comprising two elongated wire members 12.

It is appreciated that the wreath holding means 2 in some embodiments comprises a ground engagement mechanism, for example a ground spike or screw thread.

The elongate wire members 12 extend outwards from a discontinuous ring 17, arranged to surround the ground spike 9, describing splaying arms 11 extending substantially horizontally and deviated upwards to a summit 14, so as provide two substantially parallel inclined support members 13, spaced apart from the vase and ground engagement mechanism 10.

It is appreciated that the wreath holding means may be provided in various shapes and configurations to permit the display of a wreath that is complementary to the vase and displaceable portions and/or which accommodates different shapes and size of wreath.

The member ends 15 are provided with a vertically extending return so as to provide a cupping structure with the opposing inclined support members 13. In some embodiments the member end 15 may be one continuous piece with 11, 12, 13 & 14 (see FIG. 1).

In the pictured embodiment the wreath holding means comprises the discontinuous annular catch ring 17 for passage of the ground spike 9 to anchor the wreath holding means 2 in the ground.

The ground engagement mechanism 10 comprises a four sided spike 9 formed from a substantially rigid material, preferably a synthetic plastics material, such as a thermoplastics resin, for example acrylonitrile butadiene styrene (ABS).

The securement mechanism between the ground engagement mechanism 10 and the vase/housing 1 comprises a screw threading, wherein the housing 1 in the first pictured embodiment has a projection 19 with a male screw thread depending centrally, and the spike 9 has a female screw thread hole 18 depending from its top end.

The cradle 5 comprises a central perforation, through which the projection 19 passes to screw into the screw thread hole 18 of the spike 9. In this way the cradle 5 is held in a fixed position due to the securement mechanism. The cradle 5 has four displaceable portions 4, which portions 4 are hinged at 16 to four discrete members 7,8 extending upwards from the spike 9 along the sides of the housing 1.

Figure 9:
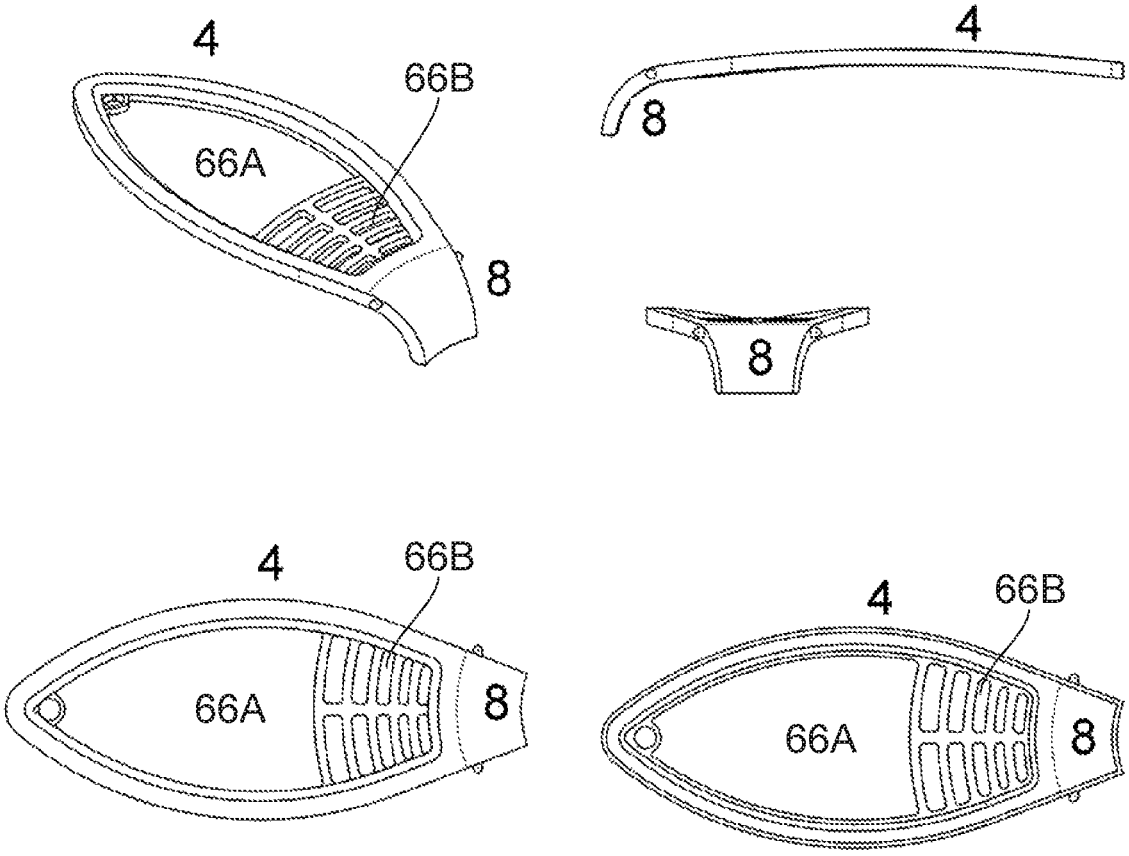
FIG. 9 show different views of displaceable portions for use with apparatus according to the present invention

The displaceable portions 4 are arranged to receive flowers, for example both bunches and single flowers or stems, so have a large central lacuna 66A as shown in FIG. 9 alongside smaller lacuna 66B.

The displaceable portions 4 comprise leaf-like substantially planar projections and basal parts 8, wherein the basal parts 8 curve away to substantially orthogonal, and wherein the basal parts 8 intersect with the projections at a hinge 3, which hinge 3 comprises holes in the cradle member 7 and side pins extending from the basal parts 8.

The basal parts 8 are arranged to contact the cradle members 7 when the planar projections 4 are substantially horizontal, and prevent further rotation of the hinge 3. In this way the projections 4 may be hinged and folded upwards if necessary.

Figure 4:
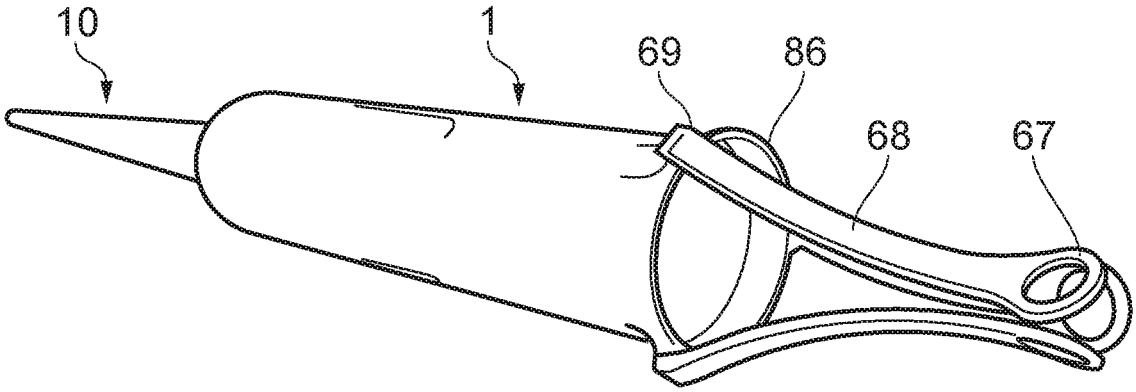
FIG. 4 shows an isometric view of a second embodiment of the apparatus according to the present invention.

With reference to the second embodiment shown in FIG. 4 the apparatus may comprise a single device formed from thermoplastic resin such as ABS or polyethylene into a vase/housing 1 and a ground engagement mechanism 10 being a spike.

The embodiment forms a combined housing 1 and ground engagement mechanism 10, which ground engagement mechanism comprises a spike depending from the housing centre.

The housing 1 has a topmost entrance which entrance is to the volume 20 and is surrounded by a lip 86, which lip 86 has three hinged displaceable portions 68 hinged to the housing 1 at hinges 69,96 . The portions 68 comprise distal circular apertures 67 for receipt of stems of plants or flowers.

Figure 5:
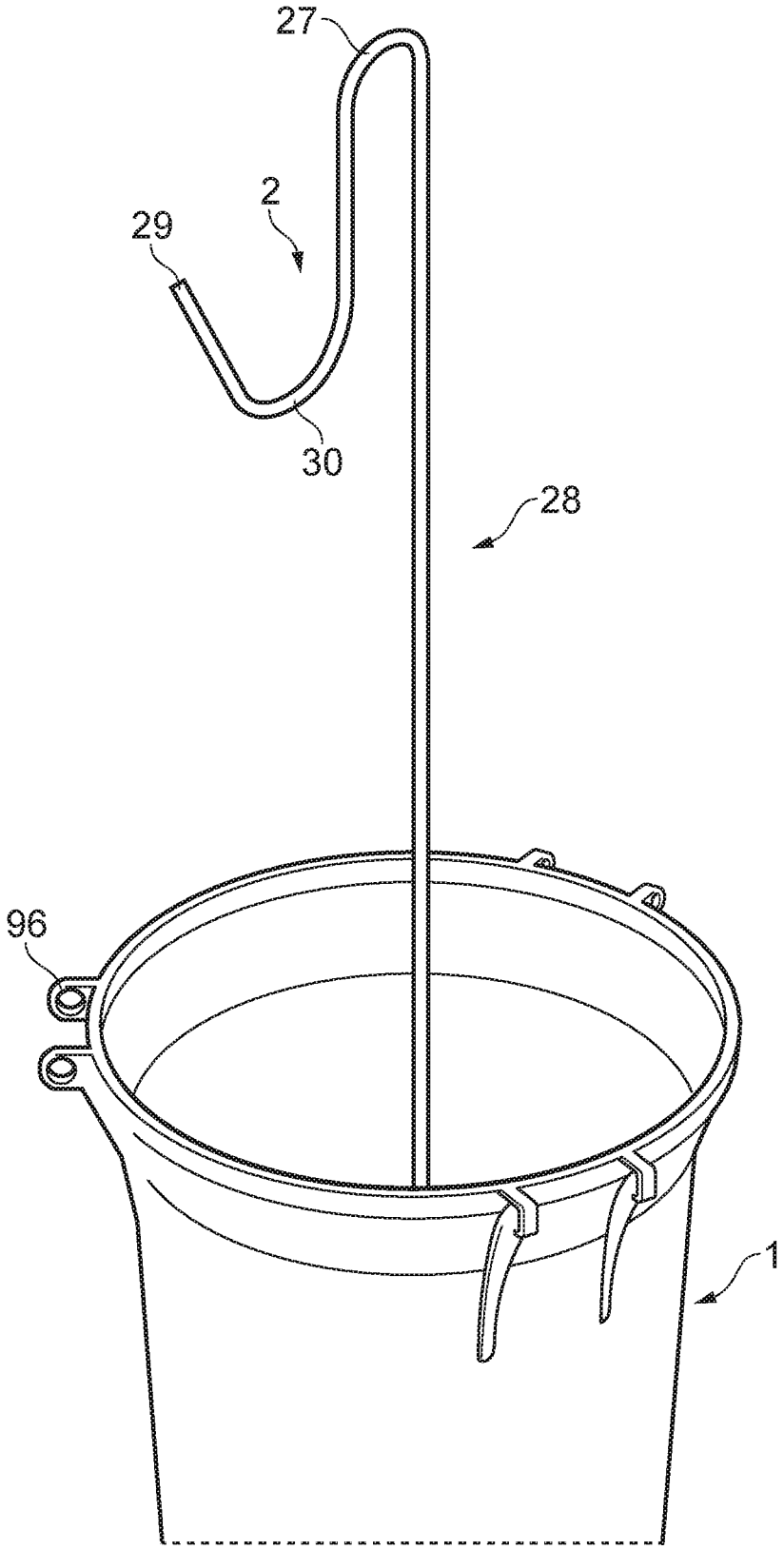
FIG. 5 shows a detail view of the second embodiment of the apparatus as shown in FIG. 4 with addition of wreath holding means.

The third embodiment as shown in FIG. 5 has a wreath holding means 2, which wreath holding means 2 comprises a vertical wire member 28, which is arranged to extend vertically from the axis of the housing 1, and comprises a summit 27 and subsequent return 30 leading to an end hook 29.

Figure 6:
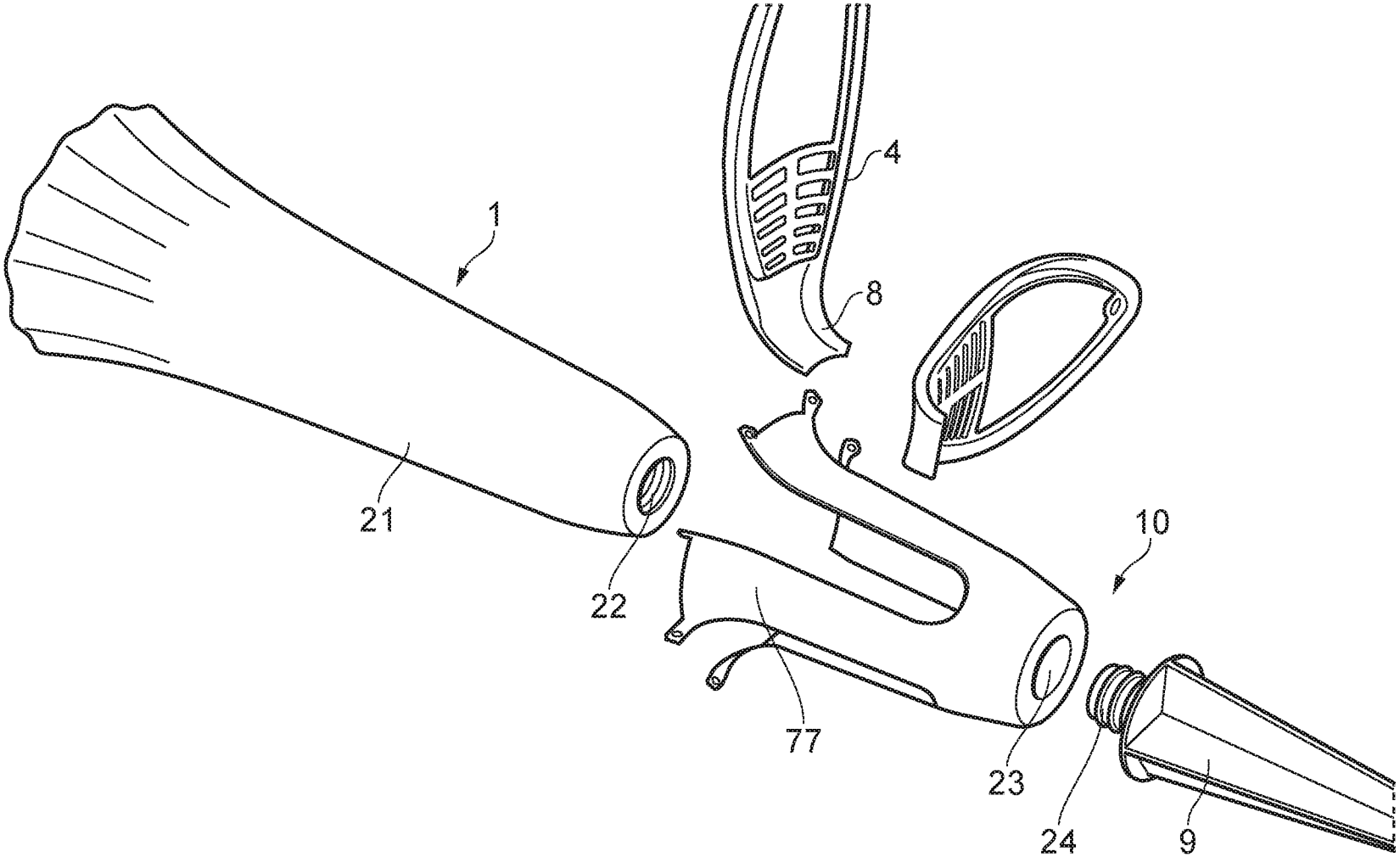
FIG. 6 shows an exploded isometric detail view of a third embodiment of the apparatus according to the present invention, being substantially similar to the first embodiment as shown in FIG. 1.

With reference to the embodiment pictured in FIG. 6 there is shown a fourth embodiment of the apparatus similar to the first embodiment and comprising a housing 1 and ground engagement mechanism 10, with a securement mechanism between the housing and ground engagement mechanism comprising a cradle 77 with displaceable portions 4.

The cradle 77 comprises a central aperture 23 through which the housing 1 and ground engagement spike 9 secure.

The spike 9 comprises a centrally extending projection 24 with a male screw thread, wherein the housing 1 has a hole 22 with an inner female screw thread.

Figure 7A:
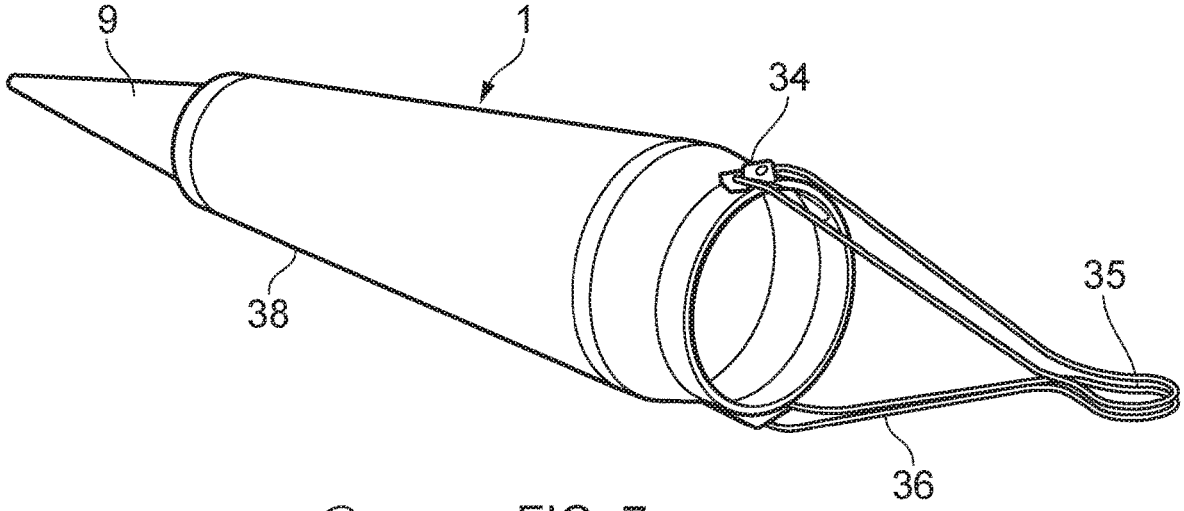
FIG. 7*a* shows an isometric view of a fourth embodiment of the apparatus according to the present invention.
Figure 7B:
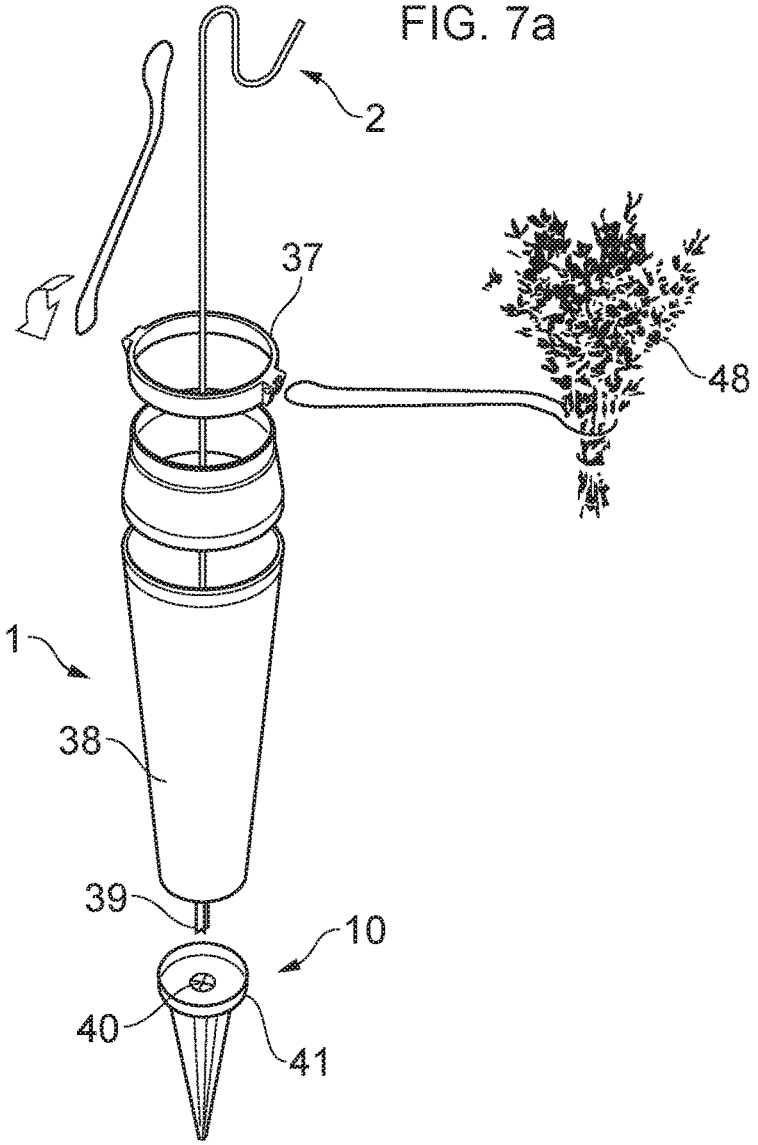
FIG. 7*b* shows an exploded isometric view of the embodiment shown in FIG. 7*a* and associated apparatus.

With reference to the fifth embodiment of the apparatus shown in FIGS. 7A & 7*b* there is shown an embodiment of the apparatus comprising a bi-partite brushed aluminium outer housing 38.

The apparatus comprises a push fit spike engagement mechanism 10, having a central hole 40 arranged to receive a depending catch 39 from the housing 1, and a peripheral lip 41 to limit toppling or stress on the catch.

The top of the housing comprises a lip 37, on which lip 37 are hinged steel wire arms 36 at two opposing hinges 34.

The arms comprise loops 35 at the distal ends, for receipt of flower stems or plants 48. In other embodiments the loop 35 may be envisaged to be much larger in order to house bunches of flowers.

The wreath holding means 2 as shown in FIG. 7*b* may be envisaged to be substantially the same as that shown in the second embodiment of the wreath holder as shown in FIG. 5.

In some embodiments the wreath holding means comprises a discrete screw thread or spike so as to embed the wreath holding means into soil for example. In this way the wreath holder is not only reliant on the spike from the vase.

Figure 8:
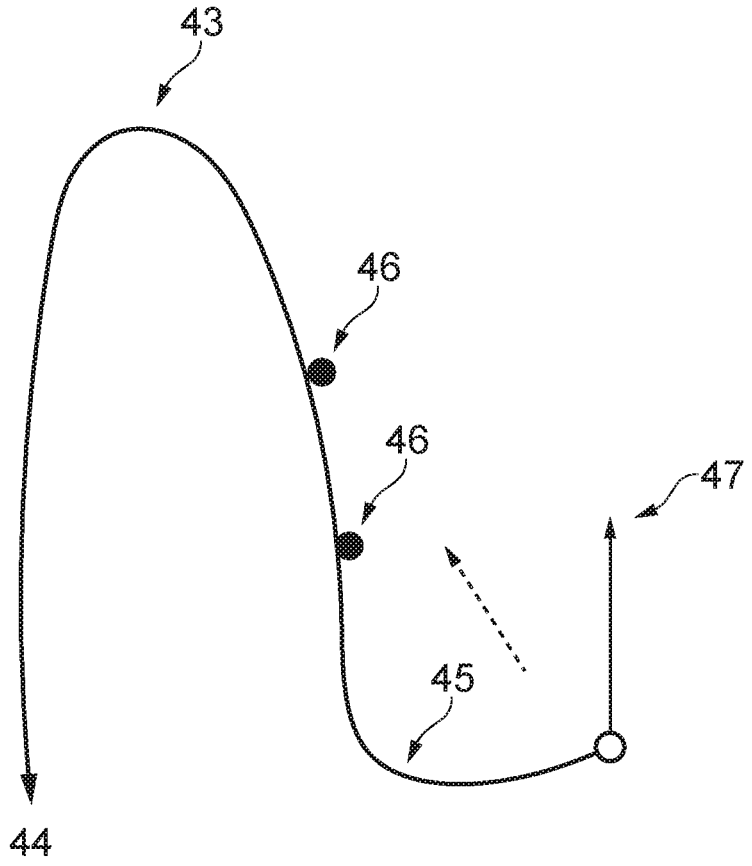
FIG. 8 shows a sketch of a second embodiment of the wreath holding means for use with the apparatus according to the present invention.

In some further embodiments (as illustrated in FIG. 8) rather than having one thick hook with a central plate for stabilizing the wreath, it may be better that the user can buy two lots of such hooks that can then be inserted side by side but slightly apart, to offer the wreath stability as needed. As pictured in FIG. 8 in such embodiments the wreath (not shown) sits in a cradle 45 from which a member 43 extends upwards having catches 46 which can push into the wreath and create stability, returning to form a point 44 to push into the ground, and at the other side of the cradle 45, providing an upward extending member 47 which can pierce through wreath or bend back to offer wreath support.

The invention has been described by way of examples only and it will be appreciated that variation may be made to the above-mentioned embodiments without departing from the scope of invention as defined by the claims, in particular but not solely combination of features of described embodiments.

The invention claimed is:

1. A vase apparatus comprising:

a vase supported by a ground engagement mechanism which enables the vase to be displaced from the ground engagement mechanism, the ground engagement mechanism being arranged to enable the vase to be presented substantially vertically;

at least one displaceable portion extending from the vase, each displaceable portion having a plurality of apertures for receiving a bunch of flowers/plants or individual sterns of flowers/plants, and a wire wreath holder formed by two or more wire portions protruding away from the vase in at least two different radial directions, each of the two or more wire portions including a heightened portion forming a backstand for a wreath, the wire wreath holder including a cradle to provide a resting place for the bottom of the wreath, wherein the wire wreath holder is arranged to space the wreath apart from the vase, and the wire wreath holder includes a separate ground engagement mechanism.

2. The vase apparatus according to claim 1 wherein a volume of the vase tapers to form a substantially frusto-conical shape, wherein said tapering is towards ground when the ground engagement mechanism is in use.

3. The vase apparatus according to claim 1 wherein the at least one displaceable portion is connected to the vase by at least one hinge.

4. The vase apparatus according to claim 1 wherein the vase is held in the ground engagement mechanism by means of gravity.

5. The vase apparatus according to claim 1 wherein the ground engagement mechanism comprises a spike.

6. The vase apparatus according to claim 1 wherein the wreath holder further comprises means to space the wreath apart horizontally from the vase.

7. The vase apparatus according to claim 1, wherein each of the at least one displaceable portion further comprises a hinged arm, the vase apparatus further comprising:

a lip upon which the hinged arm of a first of the at least one displaceable portion is arranged opposing a hinged arm of another of the at least one displaceable portion.

8. The vase apparatus according to claim 1, further comprising:

an enclosure for stem ends.

* * * * *